US005538600A

United States Patent [19]

Schultz et al.

[11] Patent Number: 5,538,600

[45] Date of Patent: Jul. 23, 1996

[54] METHOD FOR DESMUTTING ALUMINUM ALLOYS HAVING A HIGHLY-REFLECTIVE SURFACE

[75] Inventors: Paul B. Schultz, Export; Albert L. Askin, Lower Burrell, both of Pa.

[73] Assignee: Aluminum Company of America, Pittsburgh, Pa.

[21] Appl. No.: 281,304

[22] Filed: Jul. 27, 1994

[51] Int. Cl.[6] ..... C25F 1/00; C25F 3/04; C25F 3/20

[52] U.S. Cl. ..... 428/31; 252/79.3; 134/3; 428/687; 428/577; 205/213; 205/219; 205/661; 205/684

[58] Field of Search ..... 204/129.35, 129.1, 204/129.95, 141.5; 252/79.3; 134/3; 205/213–214, 219; 428/687

[56] References Cited

U.S. PATENT DOCUMENTS

| | | | |
|---|---|---|---|
| 2,108,603 | 2/1938 | Mason | 205/219 X |
| 3,052,582 | 9/1962 | Snyder | 252/79.3 X |
| 3,850,763 | 11/1974 | Zinnbauer et al. | 205/219 X |
| 4,022,670 | 5/1977 | Dean | 205/201 |
| 4,028,205 | 6/1977 | Dorsey, Jr. | 204/181.2 |
| 4,192,722 | 3/1980 | Schardein et al. | 205/301 |
| 4,230,522 | 10/1980 | Martin et al. | 156/638 |
| 4,383,898 | 5/1983 | Renton | 205/220 |
| 4,391,652 | 7/1983 | Das et al. | 148/247 |
| 4,422,886 | 12/1983 | Das et al. | 148/31.5 |
| 4,686,021 | 8/1987 | Nakanishi et al. | 204/DIG. 9 |
| 4,883,541 | 11/1989 | Tadros | 134/3 |
| 4,970,014 | 11/1990 | Garcia | 252/79.3 |
| 5,052,421 | 10/1991 | McMillen | 134/2 |
| 5,227,016 | 7/1993 | Carlson et al. | 156/665 |
| 5,321,921 | 6/1994 | Holt | 52/97 |

*Primary Examiner*—Donald R. Valentine
*Attorney, Agent, or Firm*—David W. Pearce-Smith

[57] ABSTRACT

A method of forming a highly-deflective surface on aluminum alloys. The, the composition comprising: cleaning a body formed from an aluminum alloy; electrobrightening the body; and desmutting the surface of the freshly-brightened body without etching. The bath comprises: 15–95 vol. % nitric acid and 1–85 vol. % acetic acid; 1–40 vol. % total water; and a source of fluoride ion supplying at least 35 grams per liter of fluoride. Ammonium bifluoride is the preferred source of fluoride.

20 Claims, 1 Drawing Sheet

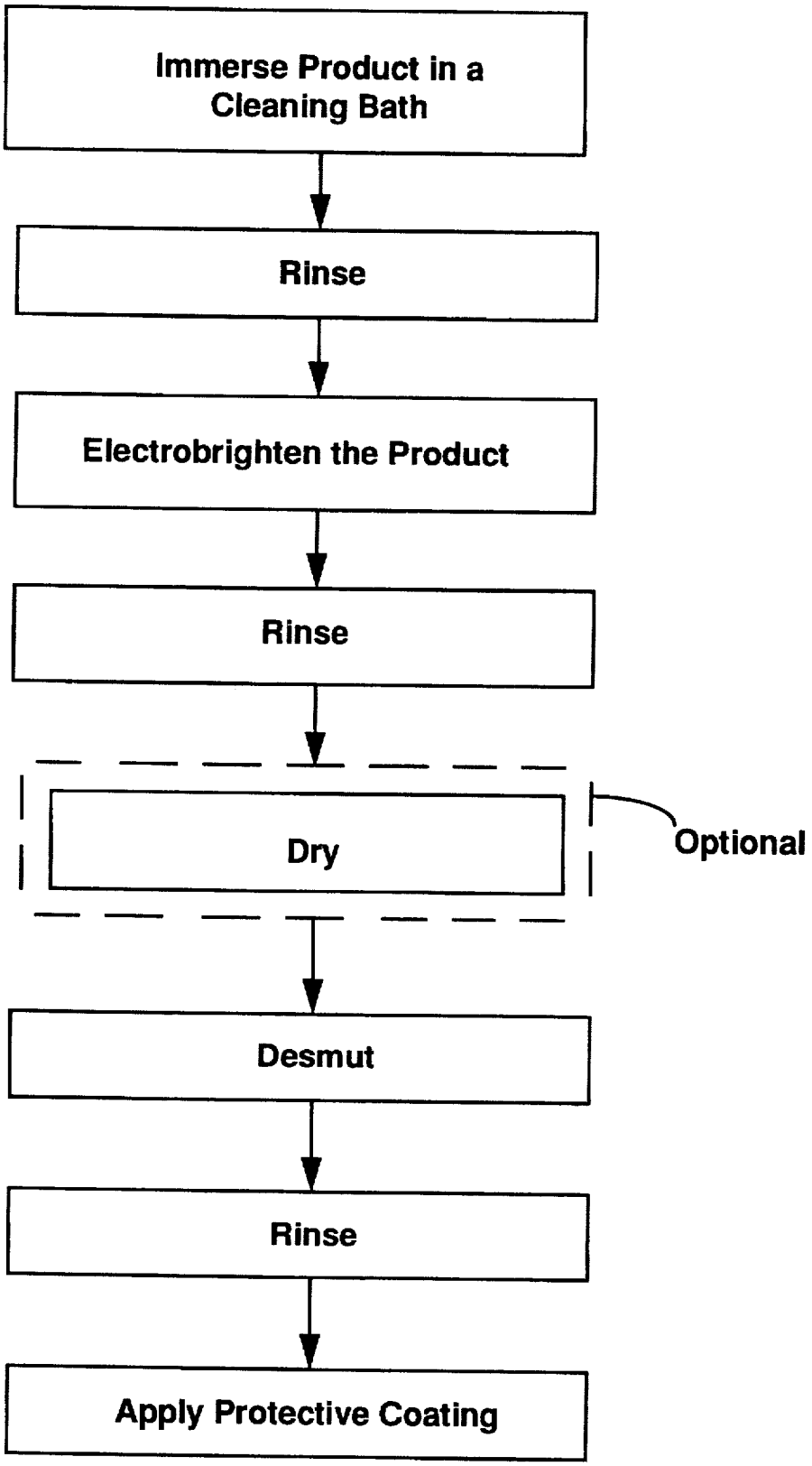
FIGURE

METHOD FOR DESMUTTING ALUMINUM ALLOYS HAVING A HIGHLY-REFLECTIVE SURFACE

TECHNICAL FIELD

The present invention relates to methods and compositions for desmutting aluminum alloys possessing highly-reflective surfaces. More particularly, the method and chrome-free compositions of the present invention relate to desmutting aluminum alloys possessing highly-reflective surfaces without etching the reflective surface.

BACKGROUND ART

Although aluminum is ordinarily considered to be a bright metal, it often presents a dull or matte-like finish due to surface roughness resulting from the operations used to shape it, i.e., rolling, casting, extrusion and the like. For some applications, it is desired that aluminum have a highly-reflective surface. The term "highly reflective" is used herein to mean a surface which is glossy or polished and capable of reflecting a clear image.

Chemical and electrochemical solutions have been developed to create a highly-reflective surface on aluminum alloys and aluminum alloy bodies. These solutions are not entirely satisfactory. Chemical solutions do not create as high a quality surface as electrochemical solutions. Electrochemicals create a superior mirror-like surface; however, the process leaves a fine particulate material on the surface of the metal. This material is referred to as "smut".

The composition of the smut varies with the alloy and the electrochemical and chemical solution used to polish the surface but is generally composed of the oxides of the alloying metals. The smut is mostly aluminum oxide as well as those metallic compounds that do not dissolve during the polishing. The smut dulls the metal surface and detracts from the polished surface appearance. In addition, if it is not removed, subsequent deposits of chemical conversion coatings and the like will not be uniform and will be loosely held where the smut is not removed.

The electrochemical solutions leave a smut that is particularly difficult to remove without etching the surface. Chromated acid solutions have been found to be effective at removing smut caused by electrochemical solutions. However, these solutions must be used at temperatures above 160° F. for them to be effective. In addition, chromated acid deoxidizing solutions are environmentally undesirable, and the Environmental Protection Agency (EPA) has enacted regulations which restrict chromium effluents. Consequently, in more and more finishing facilities, chromium treatment plants are being installed at great expense. Furthermore, restrictions on solid chromium disposal is also expensive.

Accordingly, it would be advantageous to provide a method for removing the smut from the surfaces of aluminum alloys possessing highly-reflective surfaces which does not destroy the high gloss on the surface of aluminum or diminish the ability of the surface to reflect a clear image.

Another object of the invention is to provide a chrome-free method for removing the smut from the surfaces of aluminum alloys possessing highly-reflective surfaces which does not destroy the high gloss on the surface of aluminum or aluminum alloy bodies.

Another object of the invention is to provide a chrome-free method for removing the smut from the surfaces of aluminum alloys possessing highly-reflective surfaces which is effective at room temperature.

Another object of the invention is to provide highly reflective sheet of aluminum alloys.

These and other objects and advantages of the present invention will be more fully understood and appreciated with reference to the following description.

SUMMARY OF THE INVENTION

Disclosed is a method of forming a highly-reflective surface on aluminum alloy products. The method comprises: cleaning a body formed from an aluminum alloy; electrobrightening the body; and desmutting the surface of the freshly-brightened body without etching. The bath comprises: 15–95 vol. % nitric acid; 1–85 vol. % acetic acid ($CH_3COOH$); 1–40 vol. % total water; and a source of fluoride ion supplying at least 35 grams per liter of fluoride. Ammonium bifluoride is the preferred source of fluoride. It has also been found that 5–20 vol. % of phosphoric acid is useful for removing more tenacious types of smut.

Another aspect of the present invention is electrobrightened sheet product having a highly-reflective surface. The sheet product formed by this method comprises: cleaning a sheet formed from an aluminum alloy; electrobrightening the sheet; and desmutting the freshly-brightened sheet in a bath, the bath comprising (a) an acid solution comprising 15–95 vol. % nitric acid and 1–85 vol. % acetic acid ($CH_3COOH$); (b) 0–20 vol. % water; and (c) a source of fluoride ion supplying at least 35 grams per liter of fluoride. In a preferred embodiment, the sheet product is formed into lighting sheet. In mother preferred embodiment, the sheet product is formed into automotive trim or automotive bumpers. Other uses of the sheet product include aerospace and aircraft components such as aircraft skin and fuselage skin and architectural trim.

Still another aspect of the present invention is a chrome-free bath for desmutting the surface of electropolished aluminum alloys. The bath comprises: (a) an acid solution comprising 15–95 vol. % nitric acid and 1–85 vol. % acetic acid ($CH_3COOH$); (b) 0–20 vol. % water; and (c) a source of fluoride ion supplying at least 35 grams per liter of fluoride.

BRIEF DESCRIPTION OF THE DRAWING

Other features of the present invention will be further described in the following related description of the preferred mode and embodiment which is to be considered together with the accompanying drawing wherein like figure refers to like parts and further wherein:

The sole FIGURE is a flow diagram depicting the process steps in the process of the present invention.

MODE OF CARRYING OUT THE INVENTION

The term "brightening" is used herein to mean improving the clarity or distinctness of an image reflected by a metal surface.

The term "aluminum alloy" is used herein to mean pure aluminum and alloys thereof in which the weight percent of aluminum in the alloy is at least 75 wt. %. Preferably, the weight percent of the aluminum in the alloy is greater than 95 wt. %.

The term "total water" is used herein to refer to all water that is present in the bath solution. One source of water that is included in calculating the total water is the amount of water that is present in an acid solution. Another source of water that is included in calculating the total water is an intentional addition of water such as distilled water, deionized water, tap water and the like. If an acid solution, such as nitric acid, is available in two different concentrations, the amount of intentional water that is added to the bath to form a solution with a desired total water level will vary depending on the volumes of each of the two different concentrations of the acid that are used to form the bath solution.

Turning first to the FIGURE, there is illustrated the method of creating highly-reflective surfaces on aluminum alloys. Briefly, the process involves cleaning the metal, rinsing the cleaned metal, electrobrightening the cleaned metal, rinsing the brightened metal, desmutting, rinsing and then applying a protective coating to preserve the brightened surface. The sheet may be dried before desmutting without any deleterious effect on the finished surface of the end product.

In a preferred commercial operation, the process shown in the FIGURE is a continuous process. In such an operation, the tanks are arranged in a fashion that permits the sheet to move from one tank to the next without delay. The residence time that the sheet remains in a tank is timed to facilitate the continuous flow of material though the process.

To prepare the surface of sheet or plate for brightening, the sheet is immersed in a cleaning bath. The composition of the cleaning bath is not critical to the invention, and it may be an alkali or acid solution. The cleaning bath removes oils adhering to the surface of the sheet and lubricants used in the process of rolling ingot and/or billet into sheet or plate. The oils would otherwise interfere with the electrobrightening of the sheet.

One alkaline cleaner solution that has been found to be effective is commonly referred to as A31K which is a diminution of Elf Atochem A31K. A31K is commercially available from Atochem, N.A., Cornwells Heights, Pa. The A31K solution is prepared by adding ½pound of A31K per gallon of water. The solution is heated to approximately 140° F., and the plates are immersed in the heated solution for approximately 1–2 minutes.

After cleaning, the sheet or plate is immediately rinsed to remove residue from the cleaning bath. It is important to rinse the sheet before the cleaning solution dries. Preferably, the rinse water is deionized water; however, it is not critical. Tap water may be successfully employed to remove cleaning bath from the surface of the sheet.

After the rinse, the sheets are immediately placed in an electrobrightening bath since dust particles and the like will settle on the surface and interfere with uniformity of the electrobrightening process. If the plates are not immediately placed in the electrobrightening solution, they may need to be re-rinsed and/or re-cleaned to insure the uniformity of the electrobrightening treatment on the surface of the metal.

The electrobrightening bath is heated to approximately 125°–135° F. and a voltage of 30–40 volts (direct current) is used to electrobrighten the sheet. The sheet is the anode. The exact voltage used will depend on the temperature of the bath. The higher the bath temperature, the lower the voltage required to brighten the metal sheet. The metal remains in the brightening bath for approximately one minute.

After electropolishing, the metal plate is removed from the solution and rinsed in water. Once again, the water is preferably deionized water. It is not critical that the plates be immediately desmutted. They can be allowed to dry. Dry sheets can be desmutted without diminishing the quality of the final product. However, in the continuous process contemplated by the invention, the freshly-rinsed plates will be immediately placed in the desmutting tank.

The electrobrightening process leaves areas of insoluble residue or smut on the surface of the metal. The smut dulls the surface of the metal and interferes with the ability of the surface to reflect a clear image. In addition, if the smut is not removed, when a protective coating is applied, the coating will poorly adhere to the surface.

The sheet is then placed into a desmutting solution to remove the smut and expose the brightened surface. The effectiveness of the desmutting bath must be balanced so that it is sufficiently potent to remove the smut and expose the mirror-like surface formed in the electrobrightening bath; and yet not excessively potent so that it attacks the freshly electropolished surface and etches the mirror-like surface.

The time that the plates remain in the bath is critical, since many solutions which are effective in desmutting will, if given enough time, etch the brightened surface. Since it is contemplated that the cleaning steps through desmutting will be part of a continuous system, with sheets of aluminum moving from one tank to the next, it is desirable that the desmutting solution produce the desired effect within a period of from about 0.5 to about 2 minutes.

It has been found that an optimum desmutting may be achieved by the use of a solution of from about 15–95 vol. % nitric acid; and 1–85 vol. % acetic acid ($CH_3COOH$); 0–20 vol. % water; and a source of fluoride ion supplying at least 35 grams per liter of fluoride.

Ammonium bifluoride is the preferred source of fluoride used in the desmutting bath. Other sources of fluoride include hydrofluoric acid, sodium fluoride, potassium fluoride, sodium bifluoride and potassium bifluoride. In addition, combinations of the aforementioned fluoride-containing compounds can be used to obtain the desired level of fluoride.

It is preferred that the desmutting bath contain less than 20 vol. % water. Surprisingly, higher levels of water, although effective for removing smut, have been found to etch the polished surface.

The temperature of the bath is also important. Many solutions which are not effective in desmutting at room temperature will, if heated, etch the brightened surface. Preferably, the desmutting bath is maintained at a temperature between 60°–120° F. Above about 120° F., the solution begins to etch the surface of the metal. In addition, it is desirable to desmut at a room temperature to avoid the cost associated with heating the bath above room temperature.

For smut that is more resistant to removal, a substitution of 5–20 vol. % phosphoric acid has been found to be effective. However, for most electrobrightening baths, it is believed that there is no need to resort to the use of phosphoric acid. Maintaining the amount of phosphoric acid at the lowest possible level is considered to be highly desirable from the standpoint of cost. Phosphoric acid is approximately five times more expensive than nitric acid or sulfuric acid. Therefore, there is a significant cost advantage in the use of a phosphoric acid free desmutting solution. A maximum of 20–25 vol. % phosphoric acid is considered to be the limit for maintaining a low cost. The use of higher amounts of phosphoric acid desmuts without etching; however, from a cost standpoint, is it is considered to be undesirable.

It has been found that the tenacity of the smut is related to the composition of the electrobrightening bath. It has been discovered that for plates that have been electrobrightened using inorganic based electrobrightening solutions, the substitution of at least 5 vol. % phosphoric acid is needed to remove smut and expose the mirror-like surface. Electropolish solutions that brighten sheet that benefit from the addition of phosphoric acid in the desmutting bath include those using ethylene glycol as a major component.

After desmutting, the metal is rinsed and further processed with a protective coating which acts to preserve the mirror-like finish on the sheet. Protective coatings include anodizing, painting, roll coating, electrocoating and lacquering. The type of protective coating is not considered to be essential to the present invention.

The benefit of the present invention is illustrated in the following examples. All of the examples were performed on electropolished aluminum sheet. The aluminum alloy was rolled AA5657 or AA 1100. It is believed that these alloys can be used interchangeably in the present invention. The aluminum sheet was prepared as follows. First the sheet was immersed for two minutes in an alkaline solution formed using one half pound of A31K per gallon of water. The alkaline cleaning solution was heated to approximately 140° F. The sheets are rinsed and then brightened in an electropolish solution and rinsed with deionized water. The desmutting solutions were formed using acids in the following concentrations:

$CH_3COOH$-98-100%

$HNO_3$-68-70%

EXAMPLES 1–6

Aluminum plate formed from Aluminum Association Alloy 5657 was electrobrightened using a solution formed from ELECTROPOL 100, which is commercially available from Albright Wilson of Richmond, Va. The solution was heated to 135° F. prior to immersion of the plates. The voltage used in the electrobrightening process was approximately 35 volts (±5 volts depending on the actual temperature of the bath). The plates remained in the solution for approximately one minute. The brightened plates were rinsed and then immersed in a solution to remove the smut which accumulated on the surface of the metal during the chemical brightening. The compositions of the solutions are set forth in Table 1. The source of fluoride used in the examples was ammonium bifluoride. All of the desmutting solutions had a temperature of approximately 80° F. The plates were immersed in the desmutting solutions for one minute. The effectiveness of the desmutting solutions in removing the smut remaining on the plates after the brightening bath is set forth in Table 1. The total water includes the vol. % water in the acids. Table 1 also indicates if the surface of the brightening plates was etched during the desmutting immersion.

TABLE 1

| Example | $HNO_3$ (vol. %) | $CH_3COOH$ (vol. %) | Water (vol. %) | Total Water (vol. %) | $NH_4F.HF$ g/l | Smut Removed | Surface Etched |
|---|---|---|---|---|---|---|---|
| 1 | 40 | 60 | 0 | 13 | 135 | No | — |
| 2 | 50 | 50 | 0 | 16 | 135 | No | — |
| 3 | 60 | 40 | 0 | 19 | 135 | No | — |
| 4 | 70 | 30 | 0 | 22 | 135 | Yes | No |
| 5 | 80 | 20 | 0 | 26 | 135 | Yes | No |
| 6 | 90 | 10 | 0 | 28 | 135 | Yes | No |

The results of Table 1 indicate that with no additional water added to the solution, the vol. % acetic acid should be maintained below 40 vol. % to remove the particular smut from the surface of the plates.

EXAMPLES 7–14

The procedure of Examples 1–6 were repeated except that the amount of bifluoride in the solution was changed. The composition of the solutions and results are set forth in Table 2.

TABLE 2

| Example | $HNO_3$ (vol. %) | $CH_3COOH$ (vol. %) | Water (vol. %) | Total Water (vol. %) | $NH_4F.HF$ g/l | Smut Removed | Surface Etched |
|---|---|---|---|---|---|---|---|
| 7 | 80 | 20 | 0 | 26 | 65 | No | — |
| 8 | 80 | 20 | 0 | 26 | 75 | Yes | No |
| 9 | 80 | 20 | 0 | 26 | 85 | Yes | No |
| 10 | 80 | 20 | 0 | 26 | 105 | Yes | No |
| 11 | 80 | 20 | 0 | 26 | 115 | Yes | No |
| 12 | 80 | 20 | 0 | 26 | 135 | Yes | No |
| 13 | 80 | 20 | 0 | 26 | 155 | Yes | No |
| 14 | 80 | 20 | 0 | 26 | 175 | Yes | No |

The results of Table 2 illustrate that as the amount of ammonium fluoride in the nitric/acetic solution is increased in the range of about 65–175 grams per liter, the solution removes the smut without etching the surface of the plates. The upper limit of the amount of ammonium fluoride the nitric/acetic acid solution was not established. Above the 175 grams per liter level, it is believed that the cost of the desmutting solution becomes prohibitively expensive.

EXAMPLES 15–17

The procedure of Examples 1–6 was repeated except that water was added to the nitric/acetic solution. The composition of the solutions and results are set forth in Table 3.

TABLE 3

| Example | $HNO_3$ (vol. %) | $CH_3COOH$ (vol. %) | Water (vol. %) | Total Water (vol. %) | $NH_4F.HF$ g/l | Smut Removed | Surface Etched |
|---|---|---|---|---|---|---|---|
| 15 | 80 | 20 | 0 | 26 | 135 | Yes | No |
| 16 | 80 | 20 | 5 | 31 | 135 | Yes | No |
| 17 | 80 | 20 | 10 | 36 | 135 | Yes | Yes |

The results of Table 3 illustrate that the amount of water in the nitric/acetic solution can be increased without affecting the ability of the solution to remove smut. However, the presence of the water causes the surface of the plates to etch.

EXAMPLES 18–24

The procedure of Examples 1–6 was repeated except that a different commercial electropolish solution was used to brighten the plates. The electropolish solution contained phosphoric acid ethylene glycol as major components. The composition of the desmutting solutions and results are set forth in Table 4.

TABLE 4

| Example | $HNO_3$ (vol. %) | $CH_3COOH$ (vol. %) | Water (vol. %) | Total Water (vol. %) | $NH_4F.HF$ g/l | Smut Removed | Surface Etched |
|---|---|---|---|---|---|---|---|
| 18 | 10 | 90 | 0 | 3 | 135 | No | — |
| 19 | 20 | 80 | 0 | 6 | 135 | Yes | No |
| 20 | 30 | 70 | 0 | 10 | 135 | Yes | No |
| 21 | 40 | 60 | 0 | 13 | 135 | Yes | No |
| 22 | 50 | 50 | 0 | 16 | 135 | Yes | No |
| 23 | 75 | 25 | 0 | 24 | 135 | Yes | No |
| 24 | 100 | 0 | 0 | 32 | 135 | Yes | No |

Unexpectedly, the use of 80 vol. % $CH_3COOH$ removed smut from the surface of the metal without etching. The results of Tables 1 and 4 illustrate that the amounts of nitric acid and acetic acid that are useful in removing smut without etching the surface of the metal varies depending on the composition of the electropolishing solution and the resulting smut.

EXAMPLES 25–32

The procedure of Examples 1–6 was repeated except that the electropolish solution of Examples 18–24 was used to brighten the plates. The composition of the desmutting solutions and results are set forth in Table 5.

TABLE 5

| Example | $HNO_3$ (vol. %) | $CH_3COOH$ (vol. %) | Water (vol. %) | Total Water (vol. %) | $NH_4F.HF$ g/l | Smut Removed | Surface Etched |
|---|---|---|---|---|---|---|---|
| 25 | 25 | 75 | 0 | 8 | 110 | Yes | No |
| 26 | 25 | 75 | 0 | 8 | 115 | Yes | No |
| 27 | 25 | 75 | 0 | 8 | 125 | Yes | No |
| 28 | 25 | 75 | 0 | 8 | 135 | Yes | No |
| 29 | 25 | 75 | 0 | 8 | 145 | Yes | No |
| 30 | 25 | 75 | 0 | 8 | 155 | Yes | No |
| 31 | 25 | 75 | 0 | 8 | 165 | Yes | No |
| 32 | 25 | 75 | 0 | 8 | 175 | Yes | Yes |

The results of Table 5 indicate that as the amount of ammonium fluoride in the nitric/acetic solution was increased in the range of about 110–170 grams per liter, the solution removed the smut without etching the surface of the plates. At 175 grams per liter, the surfaces of the plates were etched.

EXAMPLES 33–36

The procedure of Examples 1–6 was repeated except that the electropolish solution of Examples 18–24 was used to brighten the plates. The temperature of the solution was changed in these examples. The composition and temperature of the solutions are set forth in Table 6.

TABLE 6

| Example | $HNO_3$ (vol. %) | $CH_3COOH$ (vol. %) | $NH_4F.HF$ g/l | Total Water (vol. %) | Temp. °F. | Smut Removed | Surface Etched |
|---|---|---|---|---|---|---|---|
| 33 | 30 | 70 | 135 | 10 | 60 | Yes | No |
| 34 | 30 | 70 | 135 | 10 | 100 | Yes | No |
| 35 | 30 | 70 | 135 | 10 | 120 | Yes | No |
| 36 | 30 | 70 | 135 | 10 | 140 | Yes | Yes |

The results of Table 6 indicate that the temperature of the solution is a variable that must be controlled to remove smut without etching. Once the temperature reaches about 140° F., the surfaces of the plates were etched.

It is to be appreciated that certain features of the present invention may be changed without departing from the present invention. Thus, for example, it is to be appreciated that although the invention has been described in terms of a preferred embodiment in which the plate is formed from Aluminum Association Alloy 5657, the alloys comprehended by the present invention include aluminum alloys containing about 75 wt. % or more of aluminum (preferably more than 95 wt. % aluminum) and one or more alloying elements. Among such suitable alloying elements is at least one element selected from the group of essentially character-forming alloying elements consisting of manganese, zinc, beryllium, lithium, copper, silicon and magnesium. These alloying elements are essentially character forming for the reason that the contemplated alloys containing one or more of them essentially derive their characteristic properties from such elements. Alloys suitable for use in the present invention include Aluminum Association Alloys 1050, 1060, 1100, 1145, 1175, 1200, 1230, 1235, 1345, 1350, 3003, 5005, 5083, 5182, 5657 and 6306.

Whereas the preferred embodiments of the present invention have been described above in terms of immersion of sheet or plates, it will be apparent to those skilled in the art that the present invention will also be valuable in forming a highly-reflective surface on a continuous coil or strip of metal. In brightening and desmutting a continuous coil, parts of the coil will have been completely desmutted and recoiled before other sections of the coil have been cleaned.

What is believed to be the best mode of the invention has been described above. However, it will be apparent to those skilled in the art that numerous variations of the type described could be made to the present invention without departing from the spirit of the invention. The scope of the present invention is defined by the broad general meaning of the terms in which the claims are expressed.

What is claimed is:

1. A method of forming a highly-reflective surface on aluminum alloys, said method comprising:

cleaning a body formed from an aluminum alloy;

electrobrightening said body; and promptly thereafter desmutting the surface of the freshly-brightened body in a bath, said bath comprising:

15–95 vol. % nitric acid;

1–85 vol. % acetic acid;

1–40 vol. % total water; and a source of fluoride ions supplying at least 35 grams per liter of fluoride.

2. The method of claim 1 in which said electrobrightening is performed in an electrobrightening solution comprising ethylene glycol.

3. The method of claim 1 in which said acid of said bath comprises 15–75 vol. % acetic acid.

4. The method of claim 1 in which said acid solution of said bath comprises 25–85 vol. % nitric acid.

5. The method of claim 1 in which said body is formed from an alloy containing at least 95 wt. % aluminum.

6. The method of claim 1 in which said body is aluminum sheet.

7. The method of claim 1 in which said bath is maintained at a temperature between about 60° and 120° F.

8. The method of claim 1 in which said body is immersed in said bath for less than 2 minutes.

9. The method of claim 1 in which said body is immersed in said bath for about 1 minute.

10. The method of claim 1 in which said source of fluoride is selected from the group consisting of hydrofluoric acid, ammonium bifluoride, sodium fluoride, potassium fluoride, sodium bifluoride, potassium bifluoride and combinations thereof.

11. The method of claim 1 in which said source of fluoride is less than about 200 grams per liter of ammonium bifluoride.

12. The method of claim 1 in which said source of fluoride is about 100–175 grams per liter.

13. Electrobrightened sheet product having a highly-reflective surface, said sheet product formed by a method comprising:

cleaning a body formed from an aluminum alloy;

electrobrightening said body; and desmutting the freshly-brightened body in a bath, said bath comprising:

15–95 vol. % nitric acid;

1–85 vol. % acetic acid;

1–40 vol. % total water; and a source of fluoride ion supplying at least 35 grams per liter of fluoride.

14. The sheet product of claim 13 in which said body is lighting sheet.

15. The sheet product of claim 13 in which said body is automotive trim.

16. The sheet product of claim 13 in which said body is automotive bumpers.

17. The sheet product of claim 13 in which said body is to be a fuselage of an aircraft.

18. The sheet product of claim 13 in which said body is architectural trim.

19. Electrobrightened lighting sheet having a highly-reflective surface, said lighting sheet formed by a method comprising:

cleaning a body formed from an aluminum alloy;

electrobrightening said body; and desmutting the freshly-brightened body in a bath, said bath comprising:

15–95 vol. % nitric acid;

1–85 vol. % acetic acid;

1–40 vol. % total water; and a source of fluoride ion supplying at least 35 grams per liter of fluoride.

20. A continuous method of forming a highly reflective surface on aluminum alloys, said method comprising:

cleaning a body formed from an aluminum alloy containing at least 95 wt. % aluminum;

electrobrightening said body; and promptly thereafter immersing the freshly-brightened body in a bath comprising:

15–95 vol. % nitric acid;

1–85 vol. % acetic acid;

1–40 vol. % total water; and at least 35 grams per liter of fluoride from ammonium bifluoride;

said bath being maintained at a temperature in the range of about 60° to 120° F. for less than about 3 minutes to desmut the surface of the freshly-brightened body.

* * * * *